US005577937A

United States Patent [19]

Itoh et al.

[11] Patent Number: 5,577,937

[45] Date of Patent: Nov. 26, 1996

[54] METHOD AND APPARATUS FOR CONNECTING ELECTRONIC PARTS AND TERMINALS

[75] Inventors: Katsuya Itoh; Hisashi Sawada; Masaki Okamoto; Yoshiaki Furuta, all of Yokkaichi, Japan

[73] Assignee: Sumitomo Wiring Systems, Ltd., Mie, Japan

[21] Appl. No.: 360,450

[22] Filed: Dec. 21, 1994

[30] Foreign Application Priority Data

| | | | |
|---|---|---|---|
| Dec. 27, 1993 | [JP] | Japan | 5-350073 |
| Feb. 23, 1994 | [JP] | Japan | 6-051348 |
| Feb. 24, 1994 | [JP] | Japan | 6-052839 |

[51] Int. Cl.[6] ..... H01R 13/66

[52] U.S. Cl. ..... 439/620; 439/76.1

[58] Field of Search ..... 439/620, 439, 439/76.1, 936, 841, 855, 29

[56] References Cited

U.S. PATENT DOCUMENTS

| | | | |
|---|---|---|---|
| 3,850,498 | 11/1974 | Schor | 439/620 |
| 4,580,867 | 4/1986 | Wright et al. . | |
| 4,647,138 | 3/1987 | Muz | 439/620 |
| 4,726,638 | 2/1988 | Farrar et al. | 439/620 |
| 5,000,690 | 3/1991 | Sonobe et al. | 439/76.1 |
| 5,040,994 | 8/1991 | Nakamoto et al. | 439/76.1 |
| 5,272,594 | 12/1993 | Delamoreaux | 439/76.1 |

FOREIGN PATENT DOCUMENTS

| | | |
|---|---|---|
| 73104 | 3/1983 | European Pat. Off. . |
| 101359 | 2/1984 | European Pat. Off. . |
| 224200 | 6/1987 | European Pat. Off. . |
| 60-1775 | 1/1985 | Japan . |
| 3-187170 | 8/1991 | Japan . |

*Primary Examiner*—Khiem Nguyen
*Assistant Examiner*—Yong Kim
*Attorney, Agent, or Firm*—Oliff & Berridge

[57] ABSTRACT

Connection portions are connected to leads of a capacitor. In this condition, when connection terminals are press-fitted in terminal receiving holes, the capacitor is received in an equipment chamber. A filler is filled in the part chamber, and is solidified, thus completing the assembly. In one alternative, an electronic part, soldered to a printed board, is received within a housing. Each of female metal terminals has an abutment piece, and the abutment piece is abutted against an associated printed line on the printed board in facing relation thereto. In another alternative, the connector housing is divided into two sections, that is, a housing member and a lid, so that the terminal receiving chambers, as well as the electronic part-receiving chamber, is openable. Press-contact terminals 309 are fixedly mounted on and project from a bottom of the electronic part-receiving chamber. The press-contact terminal has press-contact blades for press-contacting a wire, and also has a retaining portion to which a lead terminal of a capacitor can be connected by soldering. The capacitor is received in the electronic part-receiving chamber, and the lead terminals are soldered respectively to the retaining portions.

21 Claims, 11 Drawing Sheets

FIG. 15
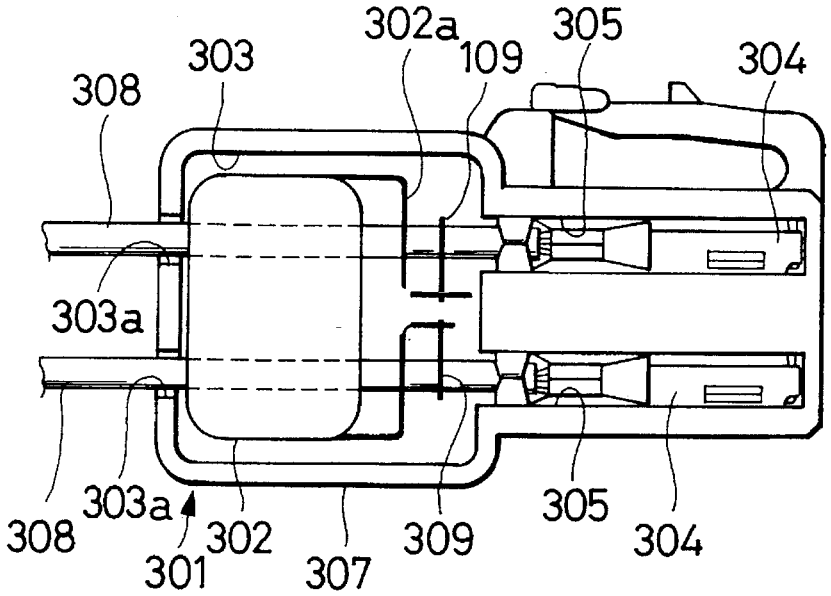
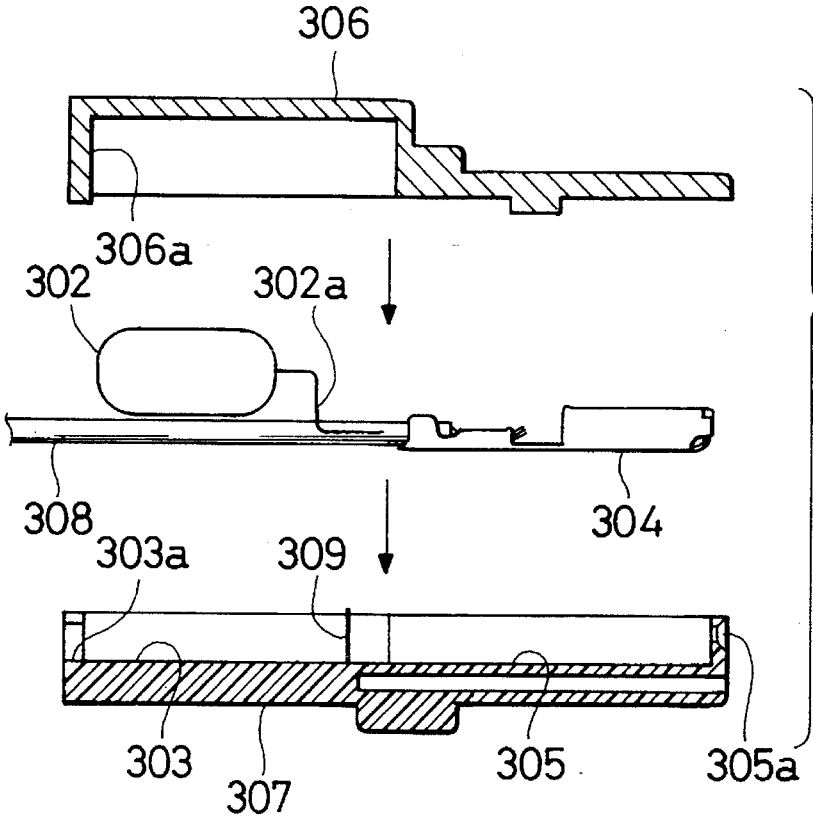
FIG. 16

METHOD AND APPARATUS FOR CONNECTING ELECTRONIC PARTS AND TERMINALS

BACKGROUND OF THE INVENTION

This invention relates to a connector containing electronic parts such as a capacitor, a resistor and diode and, more particularly, to a connector in which an assembling operation is improved.

Electronic parts, such as a diode and a capacitor, are often connected to wiring connected to equipment. For example, a noise filter of a capacitor is interposed between a power source and the equipment to suppress noises produced in the equipment. Japanese Patent Unexamined Publication (Kokai) 3-187170 discloses a connector of the type that contains such electronic parts to simplify wiring.

As shown in FIGS. 1 and 2, a male metal terminal 1 has a terminal portion 1*a* at one end, a barrel portion 1*b* at the other end, and a lead soldering portion 1*c* extending perpendicularly from an axis of an intermediate portion of the metal terminal. A plate-like core 2 has mounting grooves 2*a* formed in one of its faces for mounting the male metal terminals 1 therein. The core 2 also has retaining pawls 2*b* formed on the other face for holding an electronic part 3. The pair of male metal terminals 1, each having a wire 4 compressively connected to its barrel portion 1*b*, is mounted respectively in the mounting grooves 2*a* of the core 2. The lead soldering portions 1*c* project through one face of the core 2. The electronic part 3 is held on the other face by the retaining pawls 2*b*, and leads of the electronic part 3 are soldered to the lead soldering portions 1*c*, respectively.

As shown in FIGS. 2 and 3, the core assembly of this construction is inserted into a housing 5 from its rear opening along guides 5*a*, and tabs of the metal terminals 1 extend through a partition wall 6 into a front fitting portion 7. An insulative filler 8 of an epoxy resin is filled in a space around the core assembly, thereby fixing the core assembly.

However, for assembling this conventional connector, the epoxy resin must be filled, with the wires 4 connected to the core 2, and therefore the efficiency of the operation has been poor. Moreover, because the wires 4 and their assorted metal terminals 1 are designed to be fixedly mounted on the core 2, so that the wires 4 of a predetermined length are fixed to the connector, the length of the wiring can not be easily adjusted depending on a location of equipment to be installed.

Furthermore, the metal terminals can not be removed from the connector. Therefore, if the already connected equipment needs to be connected to another power source, this can not be done by re-adjusting the length of the wires.

Moreover, the metal terminals, each having the wire compressively connected thereto, are mounted on the core. In this condition, the electronic part is mounted on the core, and then the soldering operation is carried out. Namely, the soldering operation must be carried out while holding the core with the wires. Therefore, a problem has been encountered in that the wires tend to become obstructive, so that the operation can not be carried out easily. For the same reason, there has arisen another problem that the operation is not suited for automation.

A further problem is that the housing is bulky because of the use of the core. A further problem still is that because the epoxy resin is molded within the housing to cover the electronic part as well as the metal terminals and the core, a large amount of the epoxy resin is required.

For compressively and simultaneously connecting both the lead terminal and the wire to the metal terminal, the lead terminal is superposed on that portion of the wire to be compressively connected, and then the superposed portions must be inserted into a compressive connecting device. However, the compressive connecting operation is usually effected manually, and therefore is very cumbersome. Naturally, this compressive connecting operation must be carried out before the electronic part and the metal terminals are inserted into the connector housing, and therefore the metal terminals must be inserted respectively into the metal terminal receiving chambers, with the electronic part connected between the metal terminals, and the lead terminals are liable to be bent, so that the operation can not be carried out easily. Therefore, the efficiency of assembling the electronic part-containing connector is very poor, and hence the productivity can not be enhanced by enhancing the operation efficiency.

SUMMARY OF THE INVENTION

The present invention has been made in view of the foregoing, and an object of the invention is to provide a connector containing electronic parts of which an assembling operation can be easily effected, thereby enhancing productivity.

Another object of invention is to provide a connector containing electronic parts in which terminals can be inserted into the connector at a later stage, so that the assembling can be easily effected and the length of wires can be easily adjusted.

Further, the invention has as an object to provide a connector containing electronic parts in which the terminals are removably inserted so that the connector can be easily re-connected to another power source or other equipment.

Furthermore, yet another object is to provide a connector containing electronic parts in which the electronic parts can be positively fixed.

Moreover, still another object of the invention is to provide a connector containing electronic parts in which the amount of an epoxy resin to be filled is reduced.

According to a first aspect of the invention, there is a provided an electronic part-containing connector comprising a housing having terminal receiving holes for receiving terminals connected to equipment-side terminals, and an equipment chamber that is provided adjacent and separate from the terminal receiving holes. The equipment chamber mounts and houses an electronic part and connection terminals are connected to leads of the electronic part while end portions of the connection terminals are received in the terminal receiving holes. Each of the connection terminals has a contact portion for electrical contact with respective ones of the terminals received within each connection terminal.

Further, the terminals may be removably inserted into the terminal receiving holes, respectively. Furthermore, an insulative filler may be filled in the part chamber to thereby fix the electronic part.

According to a second aspect of the invention, there is provided an electronic part-containing connector comprising a housing for housing metal terminals each having a wire compressively connected thereto, and an electronic part received within the housing, the electronic part being connected to selected ones of said wires. A printed board is connected to the electronic part, the printed board being retained within the housing adjacent the metal terminals.

Each of the metal terminals has an abutment piece that abuts against an associated printed line on the printed board to make an electrical connection to the electronic part.

Further, the abutment piece may extend from a barrel portion of the metal terminal at one side of the terminal facing away from a terminal portion of the terminal. Furthermore, the printed board may divide the interior of the housing into terminal receiving chambers for respectively receiving the metal terminals and an electronic part-receiving chamber for receiving the electronic part.

Furthermore, a partition wall may be formed within the housing to divide the interior of the housing into terminal receiving chambers for respectively receiving the metal terminals and an electronic part-receiving chamber for receiving the electronic part. The printed board may comprise a flexible printed board, and the flexible printed board may be disposed on that side of the partition wall where the terminal receiving chambers are provided, with the electronic part retained in the electronic part-receiving chamber.

Furthermore, concave-convex retaining members may be provided within the electronic part-receiving chamber for retaining the electronic part in position.

According to a third aspect of the invention, there is provided an electronic part-containing connector comprising a connector housing having terminal receiving chambers for respectively receiving metal terminals connected to an electronic part-receiving chamber for receiving an electronic part, the electronic part having lead terminals. Press-contact terminals are fixedly mounted within the electronic part-receiving chamber, each of the press-contact terminals having a press-contact blade for press-contacting a wire connected to a respective one of the metal terminals, and also having a retaining portion connectable to respective ones of the lead terminals.

According to a fourth aspect of the present invention, there is provided a connector for housing an electronic part in communication with at least one terminal. The connector includes at least one terminal receiving chamber for receiving the terminal, an equipment chamber for receiving the electronic part, and means or a device for establishing an electrical connection between the terminal and the electronic part after the terminal is received in the terminal receiving chamber.

According to a fifth aspect of the present invention, there is provided a method for connecting at least one terminal to an electronic part. The method includes inserting a first member of the electronic part and the terminal within a first one of a first chamber and a second chamber, and inserting a second member of the electronic part and the terminal within a second one of the first and second chambers after the first member has been inserted into the first chamber, thereby electrically communicating the first member and the second member.

In the first aspect of the invention, the connection terminals may be connected at their one ends to the leads of the electronic part, respectively, while the other end portions thereof are received in the terminal-receiving holes, respectively, and each of the connection terminals may have the contact portion for electrical contact with the received terminal. The housing may have a part chamber that is provided on one side of the terminal receiving holes, and is separated from the terminal receiving holes. The connection terminals may be connected respectively to the leads of the electronic part, and the other end portions thereof are received in the terminal receiving holes, respectively. Namely, this connector can be assembled without connecting the wires. Then, the terminals connected respectively to the wires of a suitable length can be received in the terminal receiving holes, respectively. As a result, these terminals may be electrically contacted with the contact portions of the connection terminals, respectively.

In addition to the above, the terminals may be removably inserted into the terminal receiving holes, respectively, and therefore the length of the wires can be suitably changed if necessary.

Furthermore, the insulative filler can be filled in the part chamber to thereby fix the electronic part. Therefore, the electronic part can be positively fixed.

In the second aspect of the invention, the electronic part may be connected to the printed board, and the printed board may be received and retained in the housing. Each metal terminal may have an abutment piece for abutment against the printed line on the printed board, and therefore when the printed board is disposed adjacent the metal terminals, the abutment piece of each metal terminal may abut against the associated printed line on the printed board, thereby making an electrical connection to the electronic part. Here, the electronic part is not soldered to the metal terminals, and therefore the electronic part can be exchanged by removing the printed board.

Further, the abutment piece may extend from the barrel portion of the metal terminal at one side of the terminal facing away from the terminal portion of the terminal. Therefore, the abutment piece is not limited in shape by the terminal portion and the barrel portion, and hence can be formed into a desired configuration, and the degree of abutment against the printed line can be easily adjusted. Because the abutment piece is disposed at the lead-out side of the wire, the printed board disposed adjacent to the metal terminals may also be disposed at the lead-out side, and therefore the printed board may be attached in a shallow position.

Furthermore, the printed board may partition the interior of the housing into the terminal receiving chambers and the electronic part-receiving chamber, and therefore when an epoxy resin is to be filled, it is filled only in the electronic part-receiving chamber.

Moreover, the flexible printed board may be mounted over the partition wall dividing the interior of the housing into the terminal receiving chambers and the electronic part-receiving chamber. With this arrangement, the flexible printed board may be interposed between the abutment pieces of the metal terminals and the partition wall, and therefore the abutment pieces can be abutted against this board to achieve the electrical connection though the flexible printed board does not have a rigidity.

Still further, the concave-convex retaining members may be provided within the electronic part-receiving chamber, and retain the electronic part in position within the electronic part-receiving chamber. Namely, the abutment pieces of the metal terminals may be abutted against the printed board having the electronic part mounted thereon, thereby electrically connecting the metal terminals to the electronic part.

In the third aspect of the present invention, for assembling the electronic part-containing connector, the wires may be first connected to the metal terminals, respectively. This operation is effected, for example, by a method in which a front end portion of each wire is inserted into a compressive connection device, and is compressively clamped to the associated metal terminal. Then, for press-contacting the wire with the press-contact terminal, the wire must be positioned with respect to the press-contact terminal. In the present invention, because each press-contact terminal may be fixedly provided within the electronic part-receiving chamber, the positioning operation can be effected quite easily. For example, merely by placing the wire on the press-contact terminal, with the metal terminal received in the terminal receiving chamber, this operation can be completed, and thereafter the wire is pressed toward the press-contact terminal, for example, by the hands through the opening of the electronic part-receiving chamber, so that the wire is press-contacted with the press-contact blade at a proper position, thereby making an electrical connection between the wire and the press-contact terminal. Namely, there is eliminated the possibility that the wire is press-contacted with the press-contact terminal at an improper position with the result that the metal terminal is not satisfactorily received in the terminal receiving chamber. The electronic part is received in the electronic part-receiving chamber, and its lead terminals are connected respectively to the retaining portions of the press-contact terminals, for example, by soldering, thus completing the electronic part-containing connector.

These and other aspects and advantages of the present invention are described in or apparent from the following detailed description of preferred embodiments.

BRIEF DESCRIPTION OF THE DRAWINGS

Preferred embodiments are described with reference to the drawings, in which:

FIG. 15 is a top plan view of a preferred third embodiment of the invention;

FIG. 16 is an exploded, vertical cross-sectional view showing the overall structure;

DETAILED DESCRIPTION OF PREFERRED EMBODIMENTS

A first embodiment of this invention will now be described with reference to FIGS. 4 to 8. The example of this embodiment is directed to a female connector that contains a noise filter comprising a parallel-connected capacitor, and is adapted to be fitted in a male connector mounted on equipment.

Figure 1:
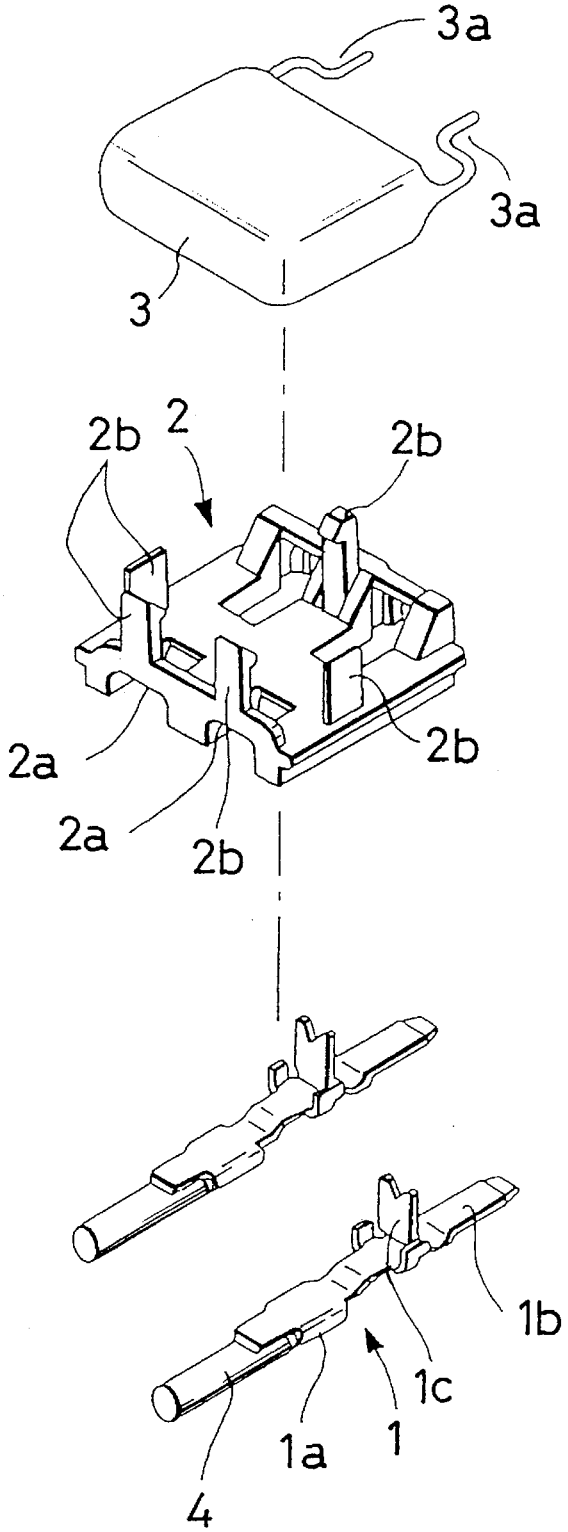
FIG. 1 PRIOR ART
FIG. 1 is an exploded perspective view of a conventional electronic part-containing connector.
Figure 2:
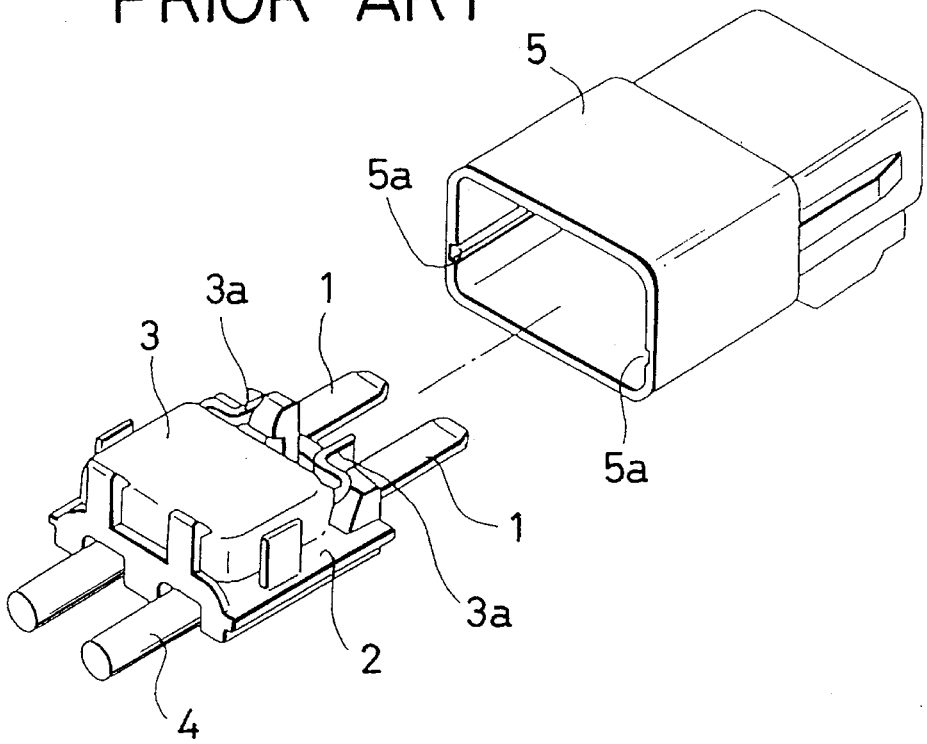
FIG. 2 PRIOR ART
FIG. 2 is an exploded perspective view of the conventional construction.
Figure 3:
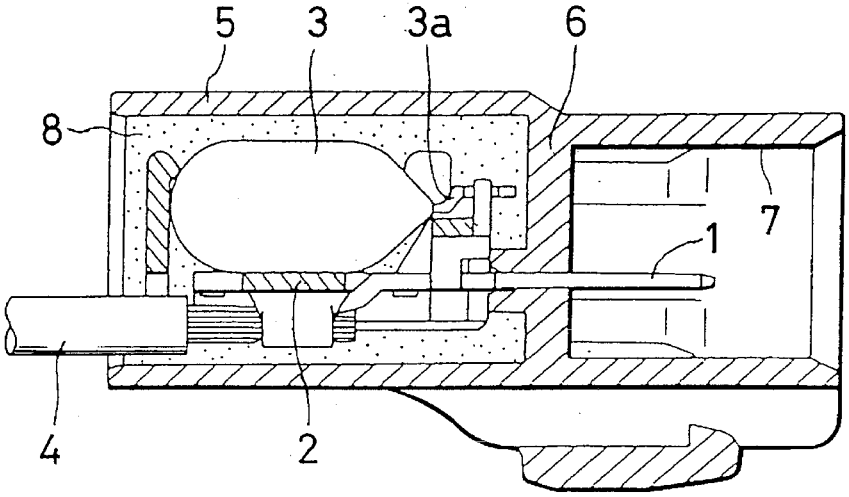
FIG. 3 PRIOR ART
FIG. 3 is a cross-sectional view of a conventional construction.
Figure 4:
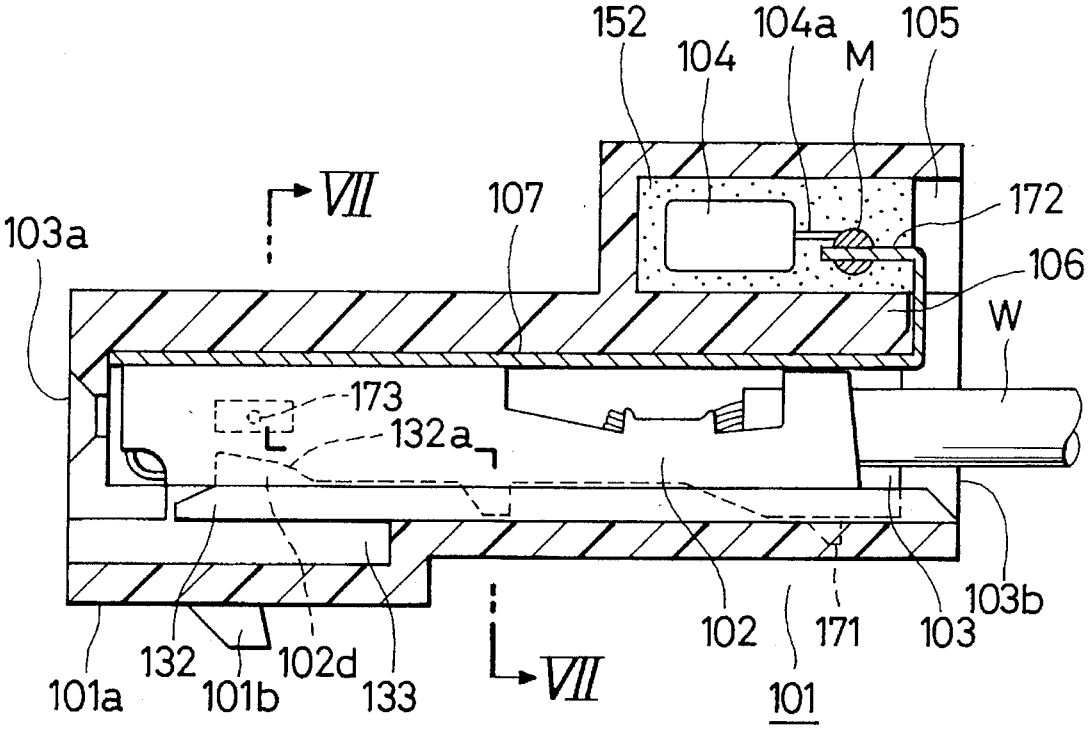
FIG. 4 is a vertical cross-sectional view of a connector containing electronic parts according to the first embodiment of the invention.
Figure 5:
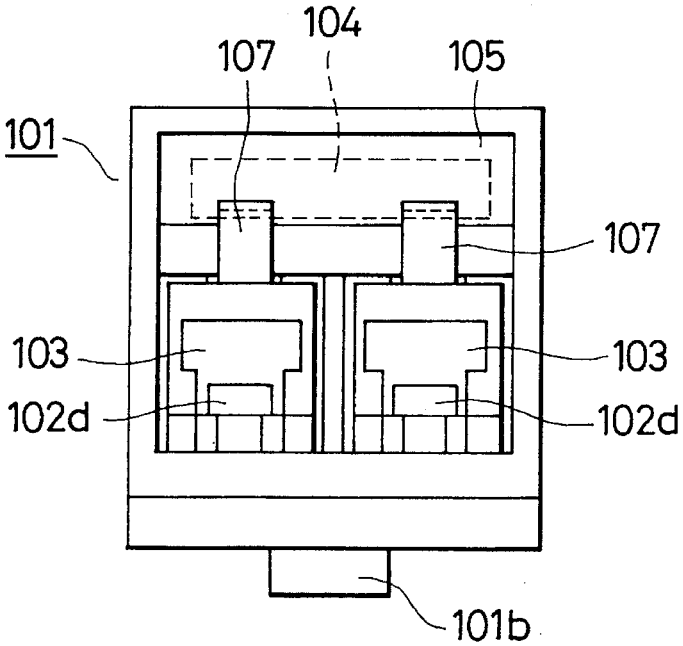
FIG. 5 is a side-elevational view of the connector of the first embodiment.

FIG. 4 is a cross-sectional view of the connector of this embodiment. A fitting portion 101*a* of a square cross-section for being inserted into a hood of the male connector (not shown) connected to the equipment is formed at an outer surface of a housing 101, and a lock piece 101*b* for engagement with the male connector is formed on and projects from a lower surface of the fitting portion 101*a*. As shown in FIGS. 4 and 5, tubular terminal receiving holes 103 for receiving terminals 102 compressively connected to ends of two wires W are formed in the housing 101 in parallel relation. A part chamber 105, receiving the capacitor 104, is formed above the terminal receiving holes, and is separated from the holes by a partition wall 106.

The tubular terminal receiving hole 103 of a square cross-section has a front opening 103*a* at its front end, and also has an insertion opening 103*b* at its rear end through which the terminal 102 is inserted. Grooves 131 are formed in a bottom surface of the terminal receiving hole 103, and are disposed at its opposite side portions, and a tongue-like lance 132 projects from a central portion of the bottom surface toward the front side. A space 133 is formed under the lance 132 to allow the front end portion of the lance 132 to be flexed upwardly and downwardly, and an engagement projection 132*a* is formed on the upper surface of the lance 132 at its front end. A pair of right and left press-fit slits 134 are formed in the lower surface adjacent to the insertion opening 103*b*. A connection terminal 107 (later described) is received in the terminal receiving hole 103 of this construction.

The electronic part chamber 105, disposed above the two parallel terminal receiving holes 103 and separated therefrom by the partition wall 106, has a box-like configuration, and is open to the rear by an opening 151 disposed above the insertion openings 103*b*.

Figure 6:
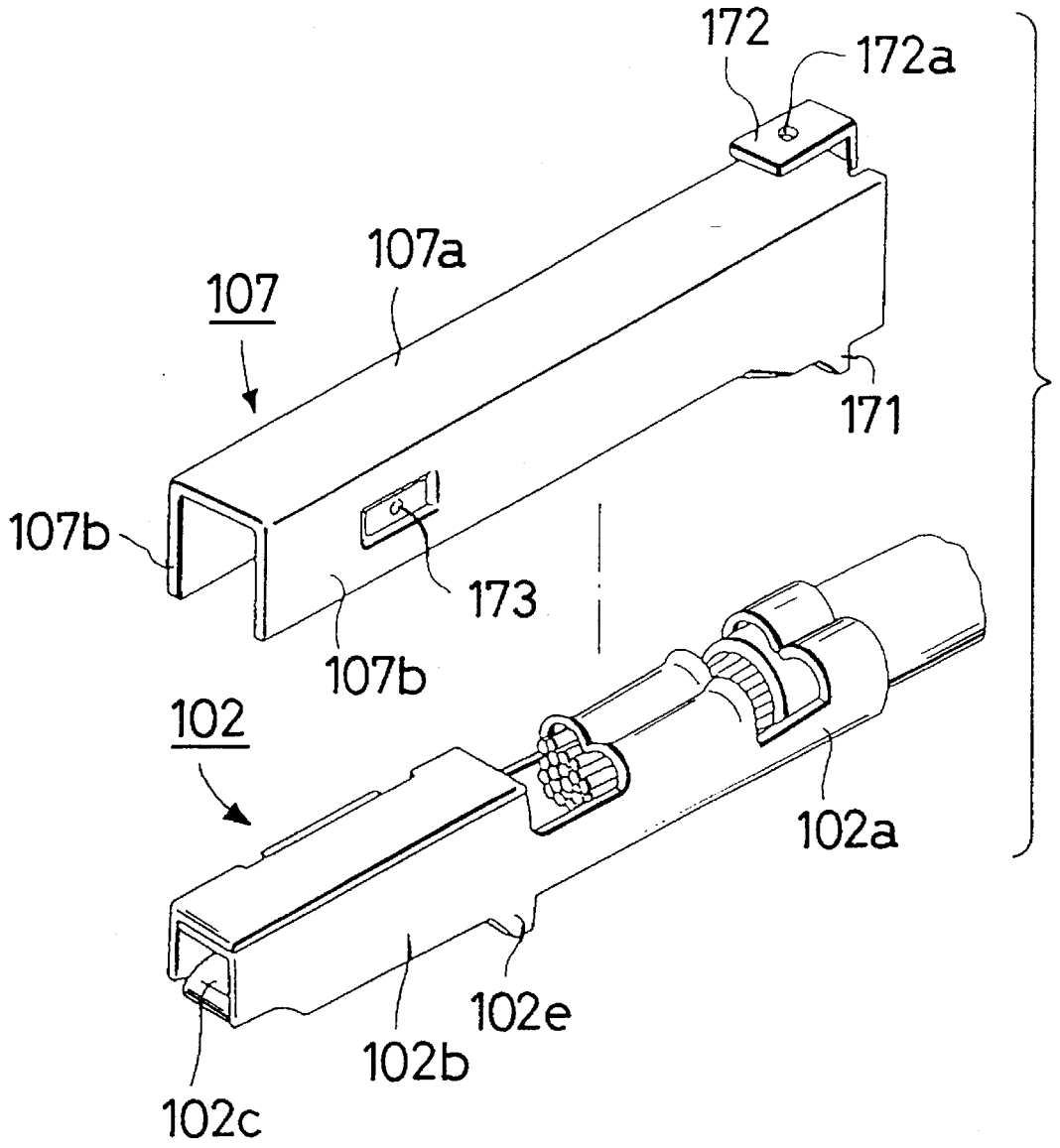
FIG. 6 is an exploded perspective view showing a terminal and a connection terminal according to the first embodiment.
Figure 7:
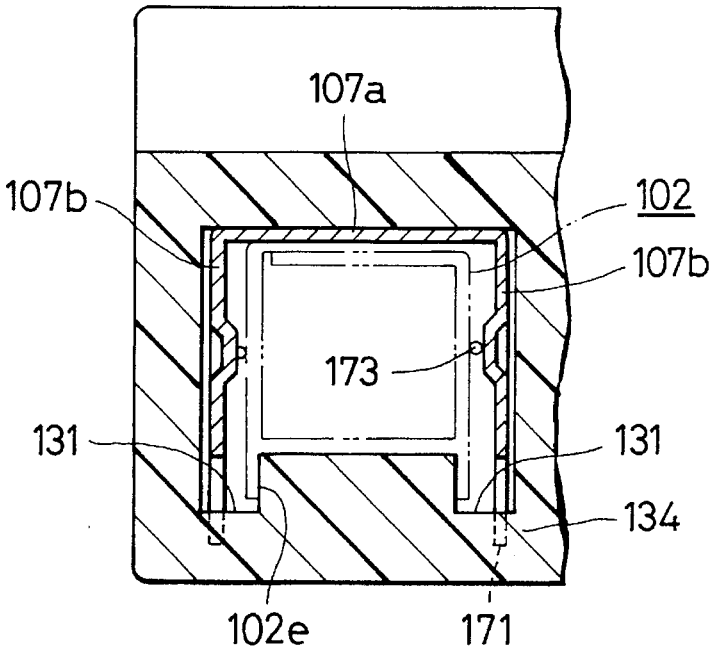
FIG. 7 is a fragmentary cross-sectional view taken along the line VII—VII of FIG. 4.
Figure 8:
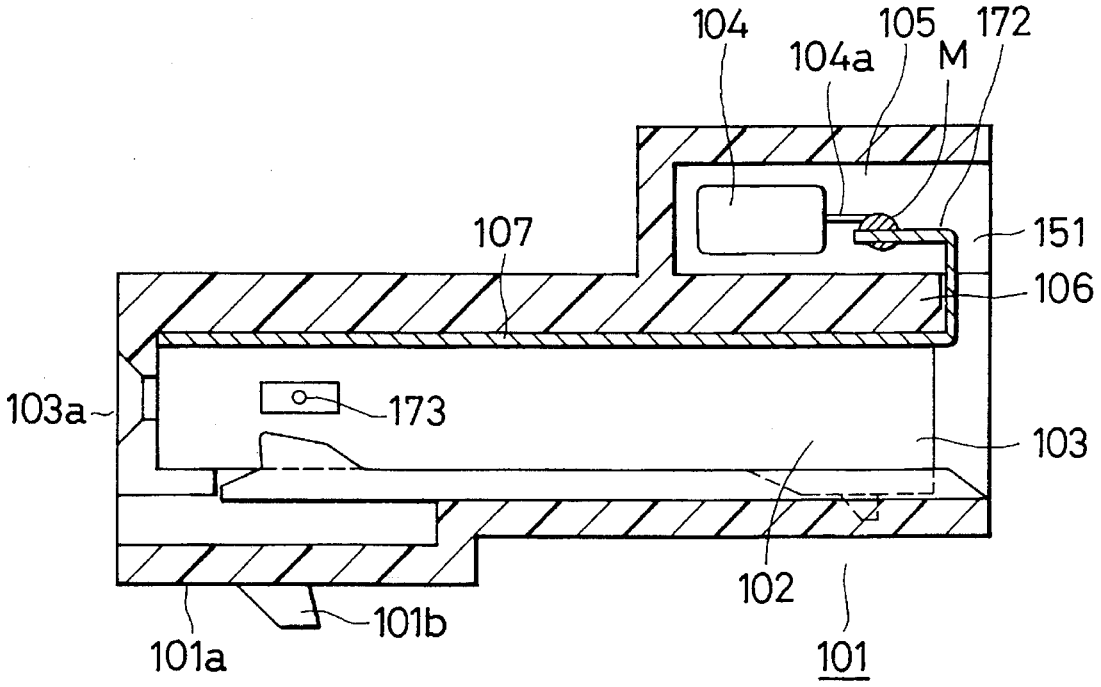
FIG. 8 is a cross-sectional view showing the process of an assembling operation.

The connection terminals 107 shown in FIG. 6 are mounted within the housing 101 of this construction. The connection terminal 107 is formed by bending an electrically-conductive metal plate into an inverted U-shape, and has side plates 107*b* formed respectively at opposite sides of an upper plate 107*a*. The side plates 107*b* have such a width and height that they can be inserted into the terminal receiving hole 103 along its inner surfaces, as shown in FIG. 8. A downwardly-projecting press-fit piece 171 is formed on a lower edge of each of the side plates 107*b* at its rear end portion, and these pieces 171 are press-fitted in the press-fit slits 134, thereby fixing the connecting terminal to the housing 101. A connection piece 172 extends from the rear end of the upper plate 107*a* in an upstanding manner, and is bent forwardly, and a mounting hole 172*a* is formed through a front end portion of the connection piece. The connection piece 172 extends into the part chamber 105 along a rear portion of the partition wall 106, and leads 104*a* of the capacitor 104 (later described) are inserted respectively in the mounting holes 172*a*, and are welded thereto by solder M.

An inwardly-projecting contact portion 173 is formed in each of the opposite side plates 107*b* in a concave manner intermediate the opposite ends thereof, and is electrically contacted with the side surface of the terminal 102. The connection terminal is connected at one end to the capacitor 104 within the part chamber 105, and the other end thereof is disposed within the terminal receiving hole 103, and the connection terminal is connected to the inserted terminal 102. An insulative filler 152 of an epoxy resin is filled in the part chamber 105 to fix the capacitor 104.

As shown in FIG. 6, the terminal 102 is formed by bending an electrically-conductive metal plate, and includes a barrel portion 102*a* for compressively clamping the wire W, a tubular terminal portion 102*b* of a rectangular cross-section provided forwardly of the barrel portion 102*a*, and a fitting hole 102*c* formed at its front end for receiving a tab of a male terminal (not shown). An engagement hole 102*d* (see FIG. 4) for engagement with the engagement projection 132*a* is formed in the lower surface of the terminal 102 intermediate opposite ends thereof, and a pair of right and left stabilizers 102*e* for being received respectively in the grooves 131 extend downwardly from the lower surface. With this construction, when the terminal 102 is inserted into the terminal receiving hole 103, the lance 132 is engaged in the engagement hole 102*d*, thereby preventing withdrawal of the terminal.

For assembling the connector of this embodiment, first, the leads 104*a* of the capacitor 104 are welded by solder M to the connection pieces 172 of the two connection terminals 107, respectively. Then, the connection terminals 107 are press-fitted into the terminal receiving holes 103, respectively. As a result, the press-fit pieces 171 of each connection terminal are press-fitted respectively in the press-fit slits 134, thereby fixing the connection terminal within the terminal receiving hole 103, as shown in FIG. 8. At this time, the connection pieces 172 are inserted into the part chamber 105, and therefore the capacitor 104 connected to the distal ends of these connection pieces is also received in the part chamber 105. Then, the filler 152 is filled in the part chamber 105, thereby fixing the capacitor. Thus, the assembling of the connector is completed. Thereafter, the terminals 102 are inserted into the terminal receiving holes 103.

In this embodiment, since the terminals 102, connected respectively to the wires W, are thus inserted after the assembling, the assembling operation can be effected easily. And besides, the length of the wires W can be chosen depending on the position of installation of the equipment.

By forcibly flexing the lance 132 downwardly to disengage the engagement projection 132*a* from the terminal 102, the inserted terminal 102 can be withdrawn. Then, the wire can be replaced by another wire of a different length.

In this embodiment, although the electronic part comprises the noise filter in which the contained capacitor 104 connects the terminals 102 in a parallel manner, any other suitable electronic part such as a resistor and a diode can be contained. Although this connector is of the female type, the invention can be applied to a male connector having male terminals.

Furthermore, in this embodiment, although the connection terminal 107 comprises the electrically-conductive metal plate of an inverted U-shaped inserted in the terminal receiving hole 103, the connection terminal may be of a suitable shape other than the shape shown in this embodiment in so far as it can be connected at one end to the electronic part, and also is connected at the other end to the inserted terminal.

Figure 9:
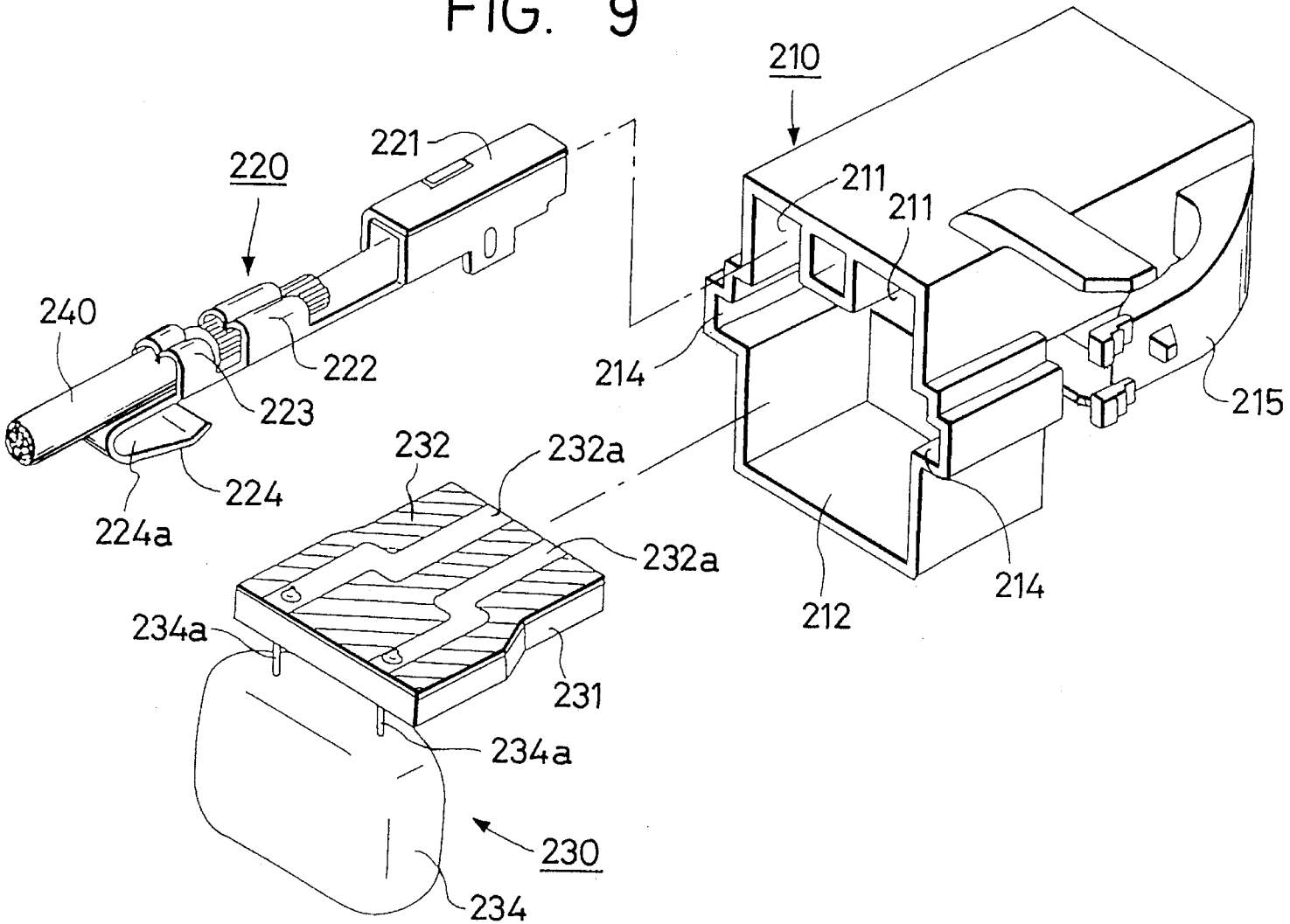
FIG. 9 is a perspective view of one preferred embodiment of an electronic part-containing connector of the present invention.

A second embodiment of the present invention will now be described with reference to the drawings. FIG. 9 is a perspective view of the second embodiment of an electronic part-containing connector of the present invention.

Figure 10:
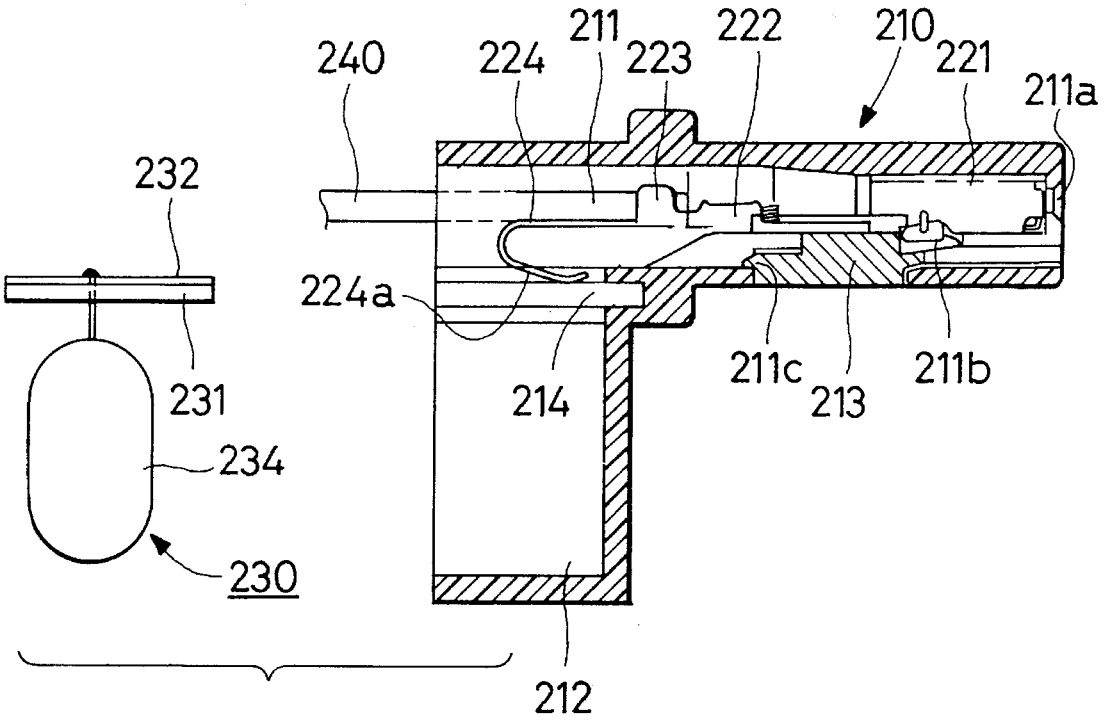
FIG. 10 is a cross-sectional view showing the process of assembling the electronic part-containing connector.

In FIG. 9, a housing 210 is designed to receive a pair of female metal terminals 220 and an electronic part assembly 230. This housing has terminal receiving chambers 211 for receiving the female metal terminals 220 through their open ends to hold them in parallel relation, and an electronic part-receiving chamber 212 in communication with the open-end portions of the terminal receiving chambers 211. As shown in FIG. 10, a small hole 211*a* for passing a mating male metal terminal therethrough is formed through the other end of each terminal receiving chamber 211. A lance 211*b* for retainingly engaging a lower surface of the female metal terminal 220 is formed on a bottom surface of the terminal receiving chamber. A retainer mounting hole 211*c* for receiving a retainer 213 for retaining the female metal terminals 220 in a secondary manner is formed through a lower wall of the terminal receiving chamber.

Grooves 214 projected horizontally outwardly are formed at regions where the terminal receiving chambers 211 are communicated with the electronic part-receiving chamber 212. A lock arm 215 elastically deformable toward and away from the side surface of the housing 210 is formed on the outer surface of the housing 210.

The female metal terminal 220 has a terminal portion 221 at its front end, and a wire barrel 222 and an insulation barrel 223 formed intermediate opposite ends thereof for compressively clamping a wire 240. A rear end portion of the female metal terminal is folded back downwardly into a U-shape to provide an abutment piece 224. The abutment piece 224 has a slanting surface 224*a* slanting downwardly from the folded end toward its distal end, and the distal end portion of this abutment piece is bent slightly upwardly.

The electronic part assembly 230 comprises a plate-like partition wall member 231, a flexible printed board 232 affixed to one face of the partition wall member 231, and an electronic part 234 mounted on the other face of the partition wall member 231 facing away from the flexible printed board 232. The partition wall member 231 is received in the housing 210, and is disposed between the terminal receiving chambers 211 and the electronic part-receiving chamber 212, and the peripheral edge of the partition wall member has such a size as to be fitted in the grooves 214. Leads 234*a* of the electronic part 234 extend through the partition wall member 231 and the flexible printed board 232, and are soldered respectively to printed lines 232*a* on the flexible printed board 232. The printed lines 232*a* are so spaced apart from each other at their rear end portions with respect to the direction of insertion of the partition wall member 231 that these rear end portions are disposed outwardly of the female metal terminals 220, respectively. The front end portions of the printed lines 232*a* are disposed closer to each other, and are disposed in registry with the mating female metal terminals 220, respectively. In this embodiment, a capacitor is used as the electronic part 34.

The operation of this embodiment of the above construction will now be described.

First, the flexible printed board 232 is affixed to one side of the partition wall member 231, and the leads 234*a* of the electronic part 234 are passed from the other side of this wall member through the wall member and the printed board, and are soldered to the printed lines 232*a*, respectively. Thus, the electronic part assembly 230 is completed. On the other hand, the wire 240 is compressively attached to the wire barrel 222 and insulation barrel 223 of the female metal terminal 220, and each metal terminal 220 is inserted into the associated terminal receiving chamber 211 in the housing 210, with the abutment piece 224 directed downwardly.

Each female metal terminal is retained in a double manner by the lance 211*b* and the retainer 213, and then the electronic part assembly 230 is inserted into the electronic part-receiving chamber 212 through the open end thereof as shown in FIG. 10. At this time, the peripheral edge of the partition wall member 231 is fitted in the grooves 214 in the housing 210. The printed lines 232*a* on the flexible printed board 232 affixed to the upper surface of the partition wall member 231 are arranged in accordance with the distance between the metal terminals 220, and as the partition wall member 231 is inserted, the front end portions of these printed lines are brought into contact with the slanting surfaces 224*a* of the abutment pieces 224 of the female metal terminals 220, respectively. Upon further insertion, the abutment pieces 224 are flexed and pressed against the printed lines 232*a*, respectively. As a result, the female metal terminals 220 are electrically connected to the electronic part 234 through the printed lines 232*a*.

Figure 11:
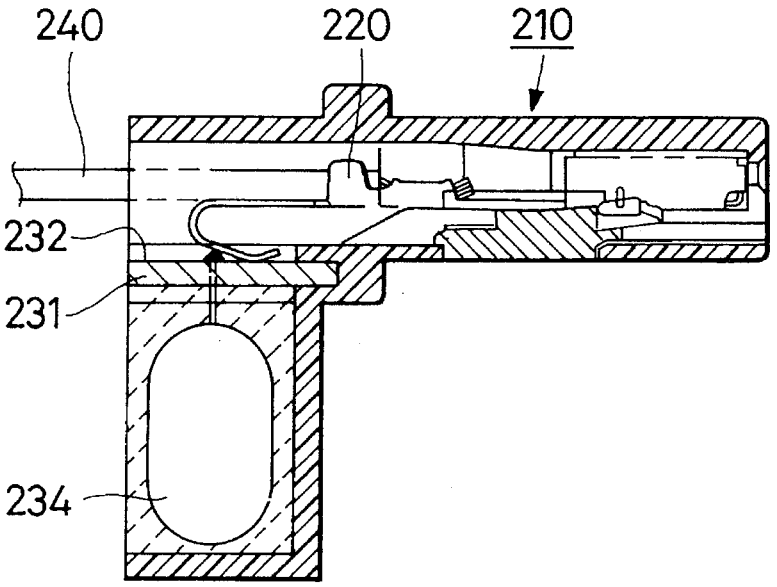
FIG. 11 is a cross-sectional view showing the process of assembling the electronic part-containing connector.

After the electronic part assembly 230 is inserted, an epoxy resin is filled in the electronic part-receiving chamber 212, and is molded as shown in FIG. 11. If such molding is not to be effected, the electronic part assembly 230 can be withdrawn for exchanging purposes. Regardless of such molding, the female metal terminals 220 can be removed. The printed lines 232*a* are spaced a greater distance from each other at their rear end portions with respect to the inserting direction, and the leads 234*a* of the electronic part 234 are soldered respectively to the thus spaced-apart portions. This prevents the soldered portions from interfering with the abutment pieces 224 when removing the metal terminals.

Figure 12:
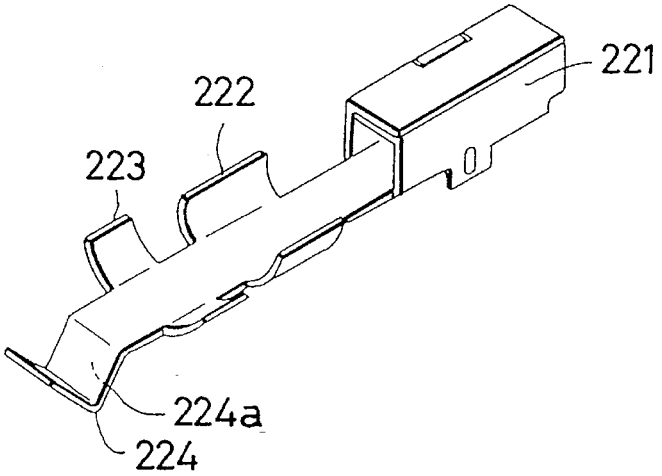
FIG. 12 is a perspective view of a modified metal terminal.

In the above embodiment, although the abutment piece 224 of the female metal terminal 220 is folded forwardly, it may extend rearwardly and be curved to be projected downwardly, as shown in FIG. 12.

Figure 13:
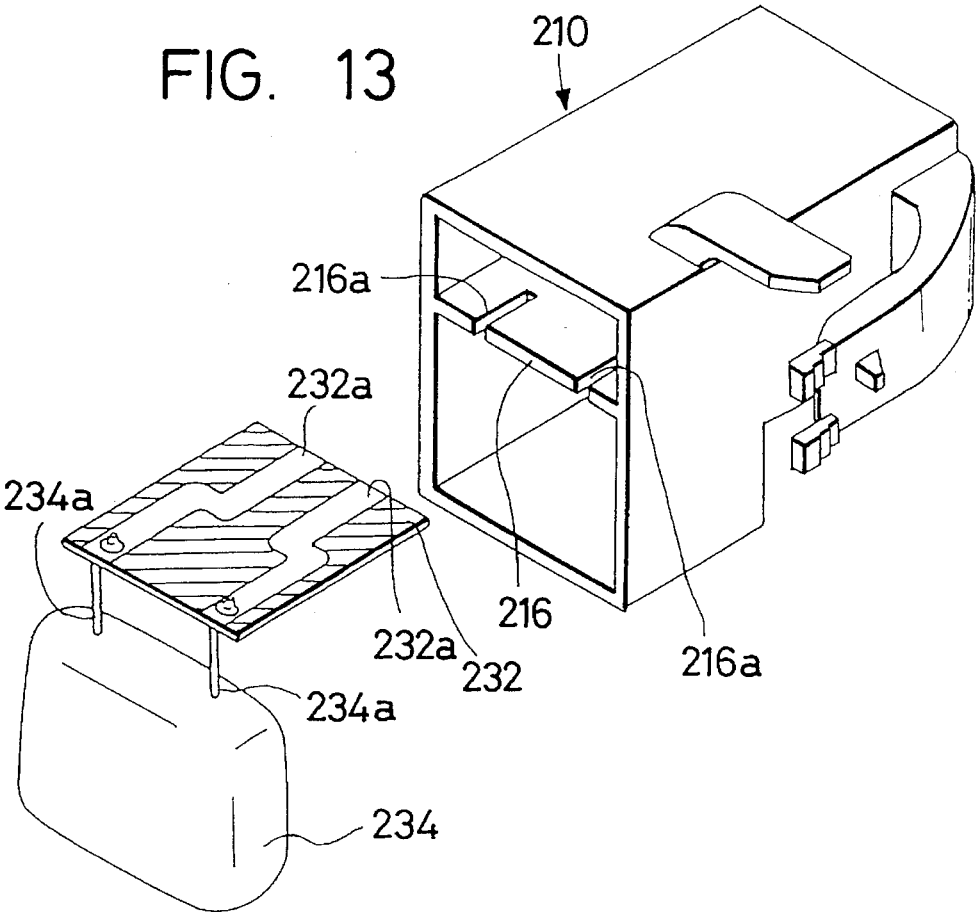
FIG. 13 is a perspective view showing a modified housing.

Instead of using the partition wall member 231, a partition wall 216 may be formed within the housing 210 to separate terminal receiving chambers 211 from electronic part-receiving chamber 212 as shown in FIG. 13. The case slits 216*a* are formed in one end portion of the partition wall 216 adjacent to an open end, and the leads 234*a* can be brought into registry with these slits, respectively. In this case, the electronic part 234 is fixed by soldering to the flexible printed board 232, and the flexible printed board 232 is inserted into the space where the terminal receiving chambers 211 are provided, and the electronic part 234 is inserted into the electronic part-receiving chamber 212. At this time, the leads 234*a* are fitted in the slits 216, respectively. With this construction, the attachment can be effected only with the use of the soft, flexible printed board 232.

If, instead of the flexible printed board, an ordinary plate-like printed board is used, it is not necessary to use the partition wall member 231. The metal terminals are not limited to the female type. The electronic part 234 can be other part than the capacitor, such as a diode and a resistor.

Figure 14:
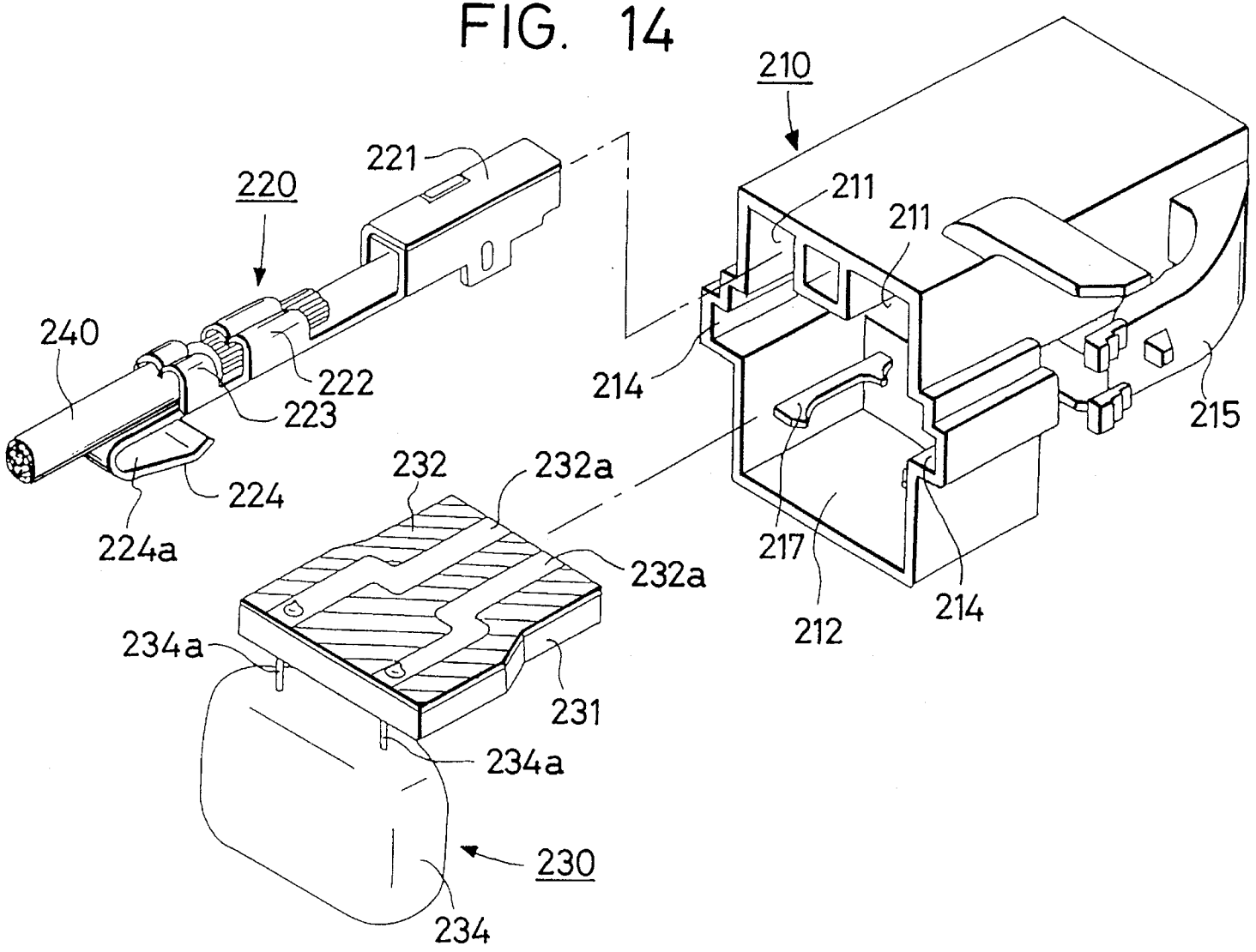
FIG. 14 is a perspective view showing another modified housing.
Figure 17:
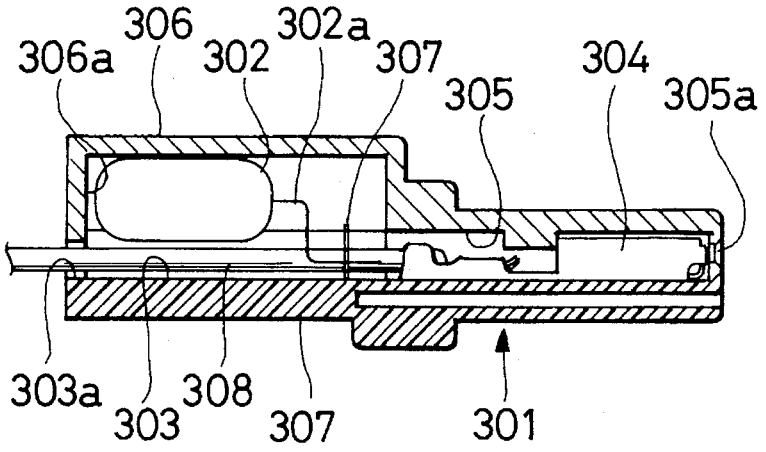
FIG. 17 is a vertical cross-sectional view showing the overall structure.

Instead of filling and molding the epoxy resin, concave-convex retaining members 217 may be formed within the electronic part-receiving chamber 212 so as to hold the electronic part 234 in position, as shown in FIG. 14. With this construction, the electronic part assembly 230 can be withdrawn for exchanging purposes.

As described above, the electronic part 234 is connected to the printed board 232 by soldering, and is inserted into the housing 210, and the abutment pieces 224, formed respectively on the female metal terminals 220, are brought respectively into abutment with the printed lines 232*a* in facing relation. Therefore, the need for soldering the electronic part 234 to the female metal terminals 220 is obviated, so that the assembling operation can be simplified. As described above, the abutment pieces of the metal terminals are abutted against the printed board having the electronic part mounted thereon, thereby electrically connecting the metal terminals to the electronic part. Therefore, there is no need to apply soldering to the metal terminals each having the wire connected thereto, and there can be provided the electronic part-containing connector in which the efficiency of the assembling operation is enhanced, and the operation is suited for automation.

Further, the abutment piece is formed at such a portion that it is least influenced by the configurations of the other portions, and therefore the design and adjustment of the electronic part-containing connector can be effected easily.

Furthermore, the printed board isolates the electronic part-receiving chamber for receiving the electronic part, and therefore the epoxy resin to be molded on the electronic part need only to be filled in this electronic part-receiving chamber, so that the amount of the epoxy resin to be used can be reduced.

Moreover, a flexible printed board can be used as the printed board. And besides, because the housing itself is provided with the partition wall, the terminal receiving chambers are completely isolated from the electronic part-receiving chamber, and the filler is prevented from leaking into the terminal receiving chamber side.

Still further, the independent electronic part-receiving chamber is provided, so that the concave-convex retaining members for retaining the electronic part can be provided. With this construction, the electronic part can be retained without the use of a filler or the like.

A third embodiment of the present invention will now be described with reference to FIGS. 15 to 19B.

In an electronic part-containing connector of this embodiment, an electronic part-receiving chamber 303 for receiving an electronic part (capacitor) 302, as well as terminal receiving chambers 305 for respectively receiving female metal terminals 304, is formed in a connector housing 301. The connector housing 301 is divided into two (upper and lower) portions, that is, a lid 306 and a housing member 307 so that the electronic part-receiving chamber 303 and the terminal receiving chambers 305 can be made open.

The terminal receiving chambers 305 are formed side by side in a front portion of the housing member 307. Each of these chambers is in the form of a groove extending in a forward-backward direction. The female metal terminals 304 are received in the terminal receiving chambers 305, respectively, and each of these terminals has a wire 308 compressively connected to its rear end portion. An opening 305*a* is formed through a front wall of each terminal receiving chamber 305, and a mating male metal terminal of another connector housing (not shown) connectable to the connector housing 301 can be passed through the opening 305*a*.

The electronic part-receiving chamber 303 is formed in a rear portion of the housing member 307, and is communicated with the terminal receiving chambers 305. The wires 308 connected respectively to the rear end portions of the female metal terminals 304 enter the electronic part-receiving chamber 305, and further extend respectively through two wire insertion grooves 303*a*, formed in a rear wall of the electronic part-receiving chamber 303, to the exterior of the connector housing 301. The wires 308, thus extended to the exterior of the connector housing 301, are connected, for example, to an electronic device mounted on a vehicle.

Figure 18:
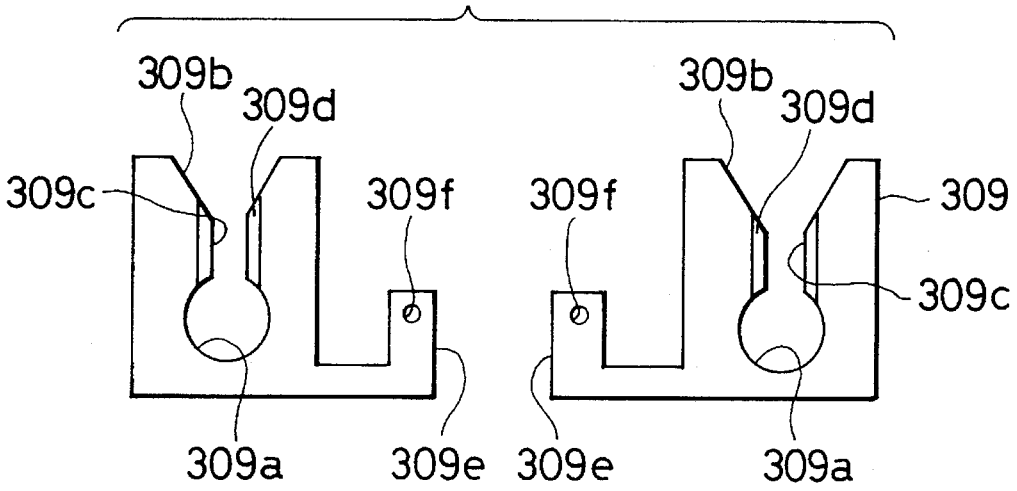
FIG. 18 is a front-elevational view showing press-contact terminals.

A press-contact terminal receiving groove (not shown) extending in a right-to-left orientation is formed in an upper surface of a bottom wall of the electronic part-receiving chamber 303, and is disposed rearwardly of the terminal receiving chambers 305. Press-contact terminals 309 shown in FIG. 18 are fitted at their lower ends in this press-contact terminal receiving groove, and upper portions of these press-contact terminals project upwardly.

Formed at a central portion of the press-contact terminal 309 is a through hole 309*a* through which the wire 308 is passed in a press-contacted condition. A notch of an inverted triangle-shape is formed in an upper edge of the press-contact terminal 309 to provide a wire rest portion 309*b*, and an insertion groove 309*c* extends from the wire rest portion 309*b* to the through hole 309*a*. This insertion groove 309*c* has opposed press-contact blades 309*d* for press-contacting the wire 308. An extension portion extends from one side edge of the press-contact terminal 309 at its lower end, and is directed upwardly to provide a retaining portion 309*e*, the extension portion extending away from an outer side surface of the housing member 307. A mounting hole 309*f* is formed through the retaining portion 309*e*. Lead terminals 302*a* of the capacitor 302 received in the electronic part-receiving chamber 303 are passed respectively through the mounting holes 309*f* of the press-contact terminals, and are soldered thereto, respectively. A rear portion of the lid 306 is bulged upwardly to provide an electronic part lid portion 306*a*, and the lid 306 is superposed on the upper side of the housing member 307, and is fused thereto, with the capacitor 302 and the female metal terminals 304 received respectively in the electronic part-receiving chamber 303 and the terminal receiving chambers 305.

An assembling operation for the electronic part-containing connector of this embodiment will now be described. First, the wires 308 are connected to the rear portions of the female metal terminals 304, respectively. Usually, this operation is carried out using a compressive connecting device, and the wire 308 is held by the hand, and the front end portion of the wire is inserted into the compressive connecting device, and is compressively clamped to the rear portion of the female metal terminal 304. Each female metal terminal 304 having the wire 308 connected thereto is received in the associated terminal receiving chamber 305 of the housing member 307 from the upper side, and the wire 308 extends to the exterior of the connector housing 301 through the wire insertion groove 303*a* in the electronic part-receiving chamber 303. Then, each wire 308 is placed on the wire rest portion 309*b* of the associated press-contact terminal 309, and is pressed down into the through hole 309*a* of the press-contact terminal 309 while holding the wire on the opposite sides of the press-contact terminal 309. As a result, the wire 308 is press-contacted with the press-contact blades 309*d* during the passage through the insertion groove 309*c*, so that the wire 308 is electrically connected to the press-contact terminal 309. Namely, merely by placing the wire 308 on the wire rest portion 309*b* of the press-contact terminal 309, the positioning of the wire 308 with respect to the press-contact terminal 309 is completed, and the wire 308 is press-contacted with the press-contact terminal 309 at the proper position.

The capacitor 302 is received in the electronic part-receiving chamber 303, and is placed on the wires 308. Each lead terminal 302*a* of the capacitor 302 is passed through the mounting hole 309*f* of the retaining portion 309*e* of the associated press-contact terminal 309, and is soldered thereto. The lid 306 is superposed on the housing 307 to cover the electronic part-receiving chamber 303 and the terminal receiving chambers 304, and is fused thereto, thus completing the electronic part-containing connector.

Thus, in the above embodiment, the capacitor 302 is connected to the wires 308 through the press-contact terminals 309, and there is no need to compressively connect the lead terminal and the wire simultaneously to the female metal terminal as in the conventional construction, and therefore the assembling can be carried out easily, and the productivity can be enhanced. Moreover, because the wires 308 can be press-contacted respectively with the press-contact terminals 309 after the female metal terminals 304 are received respectively in the terminal receiving chambers 305, each wire 308 can be easily press-contacted with the associated press-contact terminal 309 at the proper position. Thus, the female metal terminals 304 can be positively received in the terminal receiving chambers 305, respectively, and the assembling operation is carried out easily, so that productivity can be enhanced.

Moreover, for connecting the capacitor 302 to the press-contact terminals 309, this can be done by passing the lead terminals 302*a* respectively through the mounting holes 309*f* of the retaining portions 309*e* and then by soldering these lead terminals thereto, and therefore each lead terminal 302*a* will not slip off the associated retaining portion 309*e*, so that the soldering operation can be carried out easily, thus further enhancing productivity.

The present invention is not limited to the above embodiment. For example, the following modifications can be made without departing from the scope of the invention.

(1) In this embodiment, although the wires 308 are connected respectively to the female metal terminals 304, the wires may be connected respectively to male metal terminals.

(2) Although the two terminal receiving chambers 305 are provided side by side in the housing member 307, the number of the terminal receiving chambers is not limited to two, and a plurality of terminal receiving chambers may be provided in juxtaposed relation. In this case, various arrangements may be adopted. For example, a capacitor may be provided between any two adjacent ones of the wires, or a capacitor may be provided between any two predetermined wires.

(3) In this embodiment, although the capacitor 302 is received in the electronic part-receiving chamber 303, any other suitable electronic part such as a resistor and a diode may be received therein.

(4) In this embodiment, although each wire 308 is press-contacted with the associated press-contact terminal 309, respectively, after the female terminal 304 is received in the terminal receiving chamber 305, each female metal terminal may be received in the associated terminal receiving chamber after the wire is press-contacted with the press-contact terminal. Thus, the order of the assembling is not limited to that described in this embodiment, and even if the order of the assembling is changed, the effects achieved by the present invention will not change.

Figure 19A:
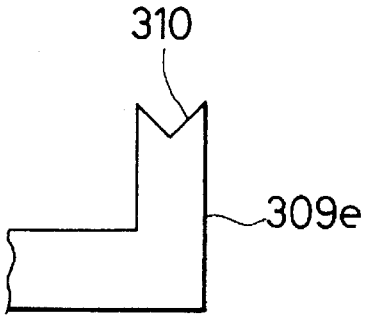
FIGS. 19A and 19B are front-elevational views showing modified retaining portions, respectively.
Figure 19B:
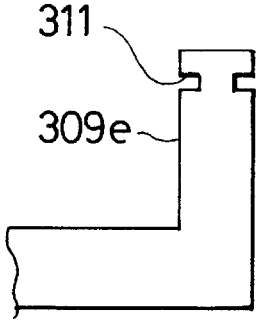

(5) In this embodiment, although the mounting hole 309*f* for passing the lead terminal 302*a* of the capacitor 302 therethrough is formed through the retaining portion 309*e* to which the lead terminal 302*a* is to be soldered, the mounting hole 309*f* is only one example of a retaining portion. Instead, a notch 310 of an inverted triangle-shape may be formed in the upper edge of a retaining portion 309*e*, or a predetermined portion of a retaining portion is notched to provide a fixing portion 311 of a constricted design, as shown in FIGS. 19A and 19B. In this case, the lead terminal 302*a* is soldered to the notched portion 310 or the fixing portion 311.

As described above, according to the invention, because the connector can be assembled in such a manner that the wires are not connected, advantageous effects are achieved in that the assembling press can be carried out easily and that the wires of a suitable length can be connected after the assembling.

In addition to the effect of the above, the terminals are removably inserted, and therefore an advantageous effect is that the length of the wires can be suitably changed.

Further, the electronic part can be positively fixed, thus providing the electronic part-containing connector of the durable type.

The electronic part can be connected to the wires through the press-contact terminals, and therefore the lead terminal and the mating wire do not need to be simultaneously compressively connected to the metal terminal, and because the press-contact terminals are fixedly mounted on the connector housing, each wire can be easily press-contacted at the proper position. Therefore, an advantageous effect is achieved in that the assembling is effected easily, thereby enhancing productivity.

The invention has been described in detail with reference to preferred embodiments thereof, which are intended to be illustrative, not limiting. Various modifications can be made without departing from the spirit and scope of the invention as defined in the appended claims.

What is claimed is:

1. An electronic part-containing connector comprising:

a housing having terminal receiving holes for receiving terminals capable of electrically communicating with mating terminals, the housing further including an equipment chamber provided adjacent and separate from said terminal receiving holes, said equipment chamber having an electronic part mounted therein; and connection members having first end portions connected to leads of said electronic part and second end portions received in said terminal receiving holes; wherein each of said connection members has a contact portion for electrical contact with at least a respective one of said terminals slidably received within each connection member.

2. The electronic part-containing connector of claim 1, wherein the terminals are removably inserted into said terminal receiving holes.

3. The electronic part-containing connector of claim 1, further comprising an insulative filler filled in said equipment chamber to thereby fix said electronic part.

4. An electronic part-containing connector comprising:

a housing for housing metal terminals each having a wire compressively connected thereto, and an electronic part received within said housing, said electronic part being connected to at least a selected one of said wires; and a printed board connected to said electronic part, said printed board being retained within said housing adjacent said metal terminals;

wherein each of said metal terminals has an abutment piece that abuts against an associated printed line on said printed board to make an electrical connection with said electronic part.

5. The electronic part-containing connector of claim 4, wherein each of said abutment pieces extends from a barrel portion of said metal terminal at one side of said terminal opposite from a terminal portion of said terminal.

6. The electronic part-containing connector of claim 4, wherein said printed board comprises a divider for dividing the interior of said housing into terminal receiving chambers for receiving the metal terminals and an electronic part-receiving chamber for receiving said electronic part.

7. The electronic part-containing connector of claim 4, further comprising a partition wall formed within said housing to divide the interior of said housing into terminal receiving chambers for receiving the metal terminals and an electronic part-receiving chamber for receiving said electronic part, said printed board further comprising a flexible printed board, said flexible printed board being disposed on that side of said partition wall where said terminal receiving chambers are provided.

8. The electronic part-containing connector according to claim 4, further comprising concave-convex retaining members within said electronic part-receiving chamber for retaining said electronic part.

9. An electronic part-containing connector comprising:

a connector housing having terminal receiving chambers for receiving metal terminals, said terminal receiving chambers being connected to an electronic part-receiving chamber, said electronic part having lead terminals; and press-contact members fixedly mounted within said terminal receiving chambers and extending toward said electronic part-receiving chamber, each of said press-contact members having a press-contact blade for press-contacting a wire connected to a respective one of said metal terminals, and each of said press-contact members also having a retaining portion connectable to a respective one of said lead terminals.

10. A connector for housing an electronic part in communication with at least one terminal capable of engaging with a mating terminal, said connector comprising:

at least one terminal receiving chamber for receiving said terminal;

an equipment chamber for receiving said electronic part; and means for selectively establishing a releasable electrical connection between the terminal and the electronic part after the terminal is received in the terminal receiving chamber.

11. The connector of claim 10, wherein the means for establishing an electrical connection includes at least one connection member disposed in said equipment chamber and said terminal receiving chamber.

12. The connector of claim 11, wherein the connection member includes at least one inwardly formed protrusion for contacting said terminal when said terminal is inserted into the terminal receiving chamber.

13. The connector of claim 12, wherein said protrusion is formed at a first end of said connection member and a second end of said connection member includes an electrically conductive portion disposed in said equipment chamber in electrical contact with said electronic part.

14. The connector of claim 10, wherein the means for establishing an electrical connection includes a printed board having at least one electrical path electrically communicated with said electronic part, and said terminal includes an abutment piece slidably engageable with said electrical path.

15. The connector of claim 14, wherein the printed board is connected to a partition wall.

16. The connector of claim 15, wherein said partition wall is fixedly mounted at a position between said equipment chamber and said terminal receiving chamber, said partition wall including slots for receiving leads of said electronic part.

17. The connector of claim 10, wherein the means for establishing an electrical connection between said terminal and the electronic part includes at least one press-contact member, said press-contact member including a narrowed portion including blades for piercing a wire connected to said terminal, said press-contact member also including at least one retaining portion for receiving a lead from said electronic part.

18. The connector of claim 10, further comprising means for separating the equipment chamber from the terminal receiving chamber.

19. The connector of claim 18, wherein the means for separating the equipment and terminal receiving chambers includes a partition wall that is fixedly connected to one of a printed board and a housing of said connector.

20. The connector of claim 10, further comprising means for releasing the terminal from the terminal receiving chamber after an electrical connection has been established.

21. A method for connecting at least one terminal to an electronic part, said at least one terminal being electrically cooperable with a mating terminal, said method comprising:

inserting said electronic part within an electronic part-receiving chamber; and releasably inserting said terminal within a terminal receiving chamber after the electronic part has been inserted into the electronic part-receiving chamber, thereby electrically connecting the terminal to the electronic part.

* * * * *